United States Patent [19]

Moss et al.

[11] Patent Number: 5,058,840

[45] Date of Patent: Oct. 22, 1991

[54] APPARATUS AND METHOD FOR REDUCING REPETITIVE OR MAINTAINED STRESS INJURIES

[75] Inventors: Thomas J. Moss, Cocoa; Marilyn Moss; James R. Moss, both of Satellite Beach, all of Fla.

[73] Assignee: Product Innovation, Inc., Satellite Beach, Fla.

[21] Appl. No.: 550,442

[22] Filed: Jul. 10, 1990

[51] Int. Cl.[5] ..... A47B 21/00

[52] U.S. Cl. ..... 248/118.5; 248/430; 248/279; 248/285; 248/918; 400/715

[58] Field of Search ..... 248/637, 639, 660, 661, 248/662, 118, 118.1, 118.3, 118.5, 122, 133, 137, 139, 141, 624, 625, 424, 425, 429, 430, 205.8, 285, 349, 279, 918, 372.1; 108/103; 400/715

[56] References Cited

U.S. PATENT DOCUMENTS

| | | | |
|---|---|---|---|
| 607,675 | 7/1898 | Barr . | |
| 844,083 | 2/1907 | Barrella | 248/279 |
| 892,612 | 7/1908 | O'Neill | 248/279 |
| 1,510,877 | 3/1923 | Wiedenmann . | |
| 1,912,287 | 5/1933 | Lundell | 248/285 |
| 2,723,097 | 11/1955 | Tyler | 108/103 |
| 2,950,890 | 1/1958 | Hough, Jr. . | |
| 4,069,995 | 1/1978 | Miller . | |
| 4,313,585 | 2/1982 | Bricker . | |
| 4,481,556 | 11/1984 | Berke et al. . | |
| 4,545,554 | 10/1985 | Latino et al. . | |
| 4,616,798 | 10/1986 | Smeenge | 248/279 |
| 4,670,738 | 6/1987 | Weinblatt . | |
| 4,687,166 | 8/1987 | Poehler | 248/279 |
| 4,688,862 | 8/1987 | Fowler | 400/715 |

FOREIGN PATENT DOCUMENTS

| | | | |
|---|---|---|---|
| 0365576 | 1/1989 | European Pat. Off. . | |
| 42022 | 10/1965 | German Democratic Rep. | 248/118 |
| 62687 | 9/1944 | Netherlands | 248/118 |

OTHER PUBLICATIONS

"Electronics Slim Digitizer Pad", Machine Design, Jan. 25, 1990.

"CAD Productivity Tools", Alpia, Inc. Feb. 1, 1990.

*Primary Examiner*—Ramon O. Ramirez
*Assistant Examiner*—Robert A. Olson
*Attorney, Agent, or Firm*—Evenson, Wands, Edwards, Lenahan & McKeown

[57] ABSTRACT

An arm rest assembly is usable with a mouse pad or keyboard and provides vertical support for a user's arm to avoid fatigue and injury. The assembly has at least one forearm cradle and a thin profile which allows a mouse or digitizer pad to be placed on an assembly platen or to insert the assembly under a keyboard and support both forearms of the using while striking the keys of the keyboard with both hands. The assembly further includes a detachable slide which is pivotable and, at the same time, allows linear movement of the arm toward and away from the assembly. An interchangeable cradle for the user's forearm has springs to counteract the arm weight and to make the cradle stable in the horizontal position while permitting some tilting.

20 Claims, 7 Drawing Sheets

APPARATUS AND METHOD FOR REDUCING REPETITIVE OR MAINTAINED STRESS INJURIES

BACKGROUND AND SUMMARY OF THE INVENTION

The present invention relates to apparatus and a method for reducing repetitive or maintained stress injuries, and, more particularly, to a cradle and method of use thereof to provide vertical support for operators of a PC mouse used as a computer input device and to a cradle and method thereof for computer keyboard.

The popularity of the personal computer for use in office automation and engineering computer-aided design and drafting (CADD) has been found to cause repetitive motion-stress injuries to mouse and keyboard operators. These injuries are primarily caused by either repetitive or maintained contraction of the musculature needed to operate various office machines. Physicians and therapists have struggled with a variety of therapeutic procedures including splinting and even surgery in an effort to reduce the patient's discomfort. The areas most commonly effected by this phenomenon include the muscles of the neck and upper shoulder girdle, the tendons about the elbow, and connective tissue structures around the wrist.

Another painful condition called "tennis elbow" or lateral epicondylitis is caused by sustained or repetitive contraction of the muscles which extend the wrist. The position of the support on the proximal forearm allows the elbow to lower slightly, lifting the wrist into a more neutral position. This neutral position eases the strain placed on the wrist extensors and their tendons, as well as the tensile stresses placed on the anterior wrist connective tissues leading to hypertrophy of the ligament which causes carpal tunnel syndrome.

Efforts to decrease the stresses placed on these structures usually take place only after the symptoms have occurred. The need for a preventative and palliative support for the upper extremities of the operator has become more evident as more repetitive motion and stress related injuries occur.

An armrest for use by persons making large use of a pen or pencil is disclosed in U.S. Pat. No. 607,675. This device comprises a lower frame consisting of longitudinal bars provided in their inner surfaces with a groove and connected at each end by crossbars. The under surfaces of the crossbars are covered with a cushion such as rubber, felt or the like to prevent marring of any object upon which the device is placed. An upper armplate has a concave shape for fitting under the forearm and has crossbars extending downwardly to receive a sliding block which is pivoted to another block in such a manner such as to permit the upper plate and the sliding blocks to move longitudinally along the lower frame and also to permit the upper plate to move upon the blocks and pivot thereon. In use, the lower frame is placed at the bottom of the page or sheet of paper to be written upon such that the forearm can rest on the upper plate which is then free to move with the arm in any direction and furnish a support for the arm without affecting its freedom of movement.

U.S. Pat. No. 1,510,877, shows a wrist support also for use by writers. A wrist encircling strap is attached to rings through which metal balls protrude for rolling contact with the surface on which the writing is to be done. Although this simple concept is designed for writing, it cannot be utilized for the kinds of movements involved with utilizing a mouse or a computer keyboard.

U.S. Pat. No. 2,950,890, shows an armrest attachment for office machines in the nature of adding machines, calculating machines and the like. The armrests consist of a base which is stationery and consists of a baseplate of substantial length extending in the fore and aft directions of the machine along one side of the machine. A side wall of the base is provided with a vertical slot for adjusting a wrist element support arm which is pivoted to the wall. A rest element plate is mounted on the arm for adjustment in the lengthwise direction.

Another type of device used for arm support is shown in U.S. Pat. No. 4,069,995 which utilizes what is known as an underlying dynamic suspension system for a feeder pan which is the term commonly used for arm support in occupational therapy. In this connection, three column members arranged in an equilateral triangular array provide a laterally deflectable column that mounts a table in parallel with a base to maintain the parallel relationship as the cable members constituting the column members are laterally deflected, but not longitudinally compressed.

Another simple method used for aiding writers, draftsmen and the like is disclosed in U.S. Pat. No. 4,313,585 in which a rolling platform for supporting a writer's hand has a plurality of cleats into which ball-bearings are inserted at the corners.

In machines such as the keyboards of computer terminals, it has been proposed in U.S. Pat. No. 4,545,554 to provide a wrist support in the form a two knobs which when turned, raise or lower support bar relative to a base. The base can have a portion sized so that it can extend under a keyboard to prevent rocking or tilting of the wrist support when in use.

Another wrist rest that is currently being marketed is an anti-static wrist rest which fits all PC keyboards and is designed to help prevent wrist strain. It is also designed to hold the keyboard at a more comfortable angle. Although this rest may work for wrist support, it does not solve problems associated with the elbows, neck and upper shoulder girdle.

Various devices are known for persons with severe physical handicaps. These devices include ball bearing feeders, swivel arm troughs and table clamp arm positioners. These devices are not, however, designed for use with computer peripheral equipment.

There are CAD productivity products on the market which attempt to prevent fatigue, discomfort and injury in using computer keyboards and the like. Such CAD furniture includes a keyboard/digitizer surface which tilts to prevent wrist fatigue, telescope to reduce operator fatigue, especially eye fatigue and travels from below the monitor surface to above the monitor surface, and which has an adjustable padded palm rest. Again, no simple solution is provided for solving the problems associated with arm and wrist movements.

Thin digitizer pads on tables are also known as shown in Machine Design (Jan. 25, 1990), p. 59. This pad has a 1/32 inch thickness and allows the digitizer to be part of the desktop.

None of the foregoing devices provide a simple and thin portable installation which is extremely easy to set up and inexpensive to manufacture and, at the same time, solves the problems associated with a PC operator's upper extremities resulting from repetitive motors and stress.

It is, therefore, an object of the present invention to reduce stresses in the operator's upper extremity to reduce repetitive motion and stress injuries.

It is another object of the present invention to increase user comfort with a portable installation which is easy to set up and which does not require additional desk top area.

It is yet a further object of the present invention to provide an apparatus which has a thin profile and low manufacturing costs.

We have found that by supporting the weight of the arm, the upper trapezius and shoulder girdle muscles are allowed to release their sustained contraction. This principle is analogous to the use of an armrest on a lounge chair.

A first embodiment of the present invention is useful for operators who use a mouse as an input device which is commonly the case with graphics and CADD software packages. Generally speaking, the present invention comprises a cradle which provides a vertical support to the arm, but allows free movement in the horizontal plane sufficient to allow complete coverage of the mouse pad. The cradle can be mounted with a threaded shank to allow simple height adjustment for custom operator comfort. The cradle shank can be threaded into a lubricated plastic threaded support post or the like providing a low friction swivel. The threaded support can be attached to a detachable linear slide assembly that can also be supported and pivots at the end opposite from the cradle. This pivoting leg of the slide is supported near its other end by a bracket containing two rollers that contact the desk or tabletop. The fixed pivot is attached to a sheet metal platen assembly which is supported at the front end by two rubber feet and at the rear end by two vacuum assemblies in the form of suction cups or handle-actuated diaphragms.

In the relaxed position of an embodiment using the diaphragms, the diaphragms conform to the tabletop. Rotation of the handle through 180° raises the diaphragms and causes a pressure difference on the diaphragms resulting in approximately thirty pounds of holding force to the tabletop. It will, of course, be appreciated that other clamping devices can be used to provide hold down such as threaded clamps, toggles, and the like. The vacuum assemblies are presently preferred because they appear to provide the greatest flexibility and ease of installation.

It is further contemplated that the top of the platen can be covered with a mouse pad which is a foam rubber cushion covered with a nylon fabric and with a thin digitizer pad or tablet. The foregoing approach can be used also with digitizer pucks, digitizer pens or trackballs. The apparatus can also be used directly as a three dimensional input device. In this application, rotational motion of the slide at its pivot would be attached to a transducer and would provide the "X" input while linear motion of the slide is the "Y" input via a linear transducer, and the rotation of the cradle is the "Z" input with a third transducer. An auxiliary keypad can be provided for the operator's fingers. An algorithm of the transducer signals can be combined to provide a more natural feedback. Thus, moving the pointer in the "X" direction can cause some rotation and translation, but still result in "X" motion feedback.

According to another presently preferred embodiment of the present invention designed for PC keyboard use, a cradle similar to the cradle described above is used but is wider and contains two pivoting slide assemblies and two cradle armrests.

The cradle provides an upward biasing force to counteract much of the operator's arm weight. This force which is slightly less than the weight of the arm is provided by two low rate torsion springs that are installed in such a way as to make the cradle stable in the horizontal position. The cradle can tilt approximately ±10 degrees from the horizontal and move vertically for about 1.25 inches at nearly a constant upward force allowing it to comply to the normal arm movement of the prescribed task. The linear slide can use eight cylindrical rollers made from an engineered plastic (PPS with 30% carbon fiber) riding on formed sheet metal rails, shaped to provide a low profile.

The presently preferred embodiments of the present invention have several advantages over known arm and hand rests of the type previously described. The low profile vacuum cups and diaphragms in the present invention present a thin design. Vacuum cups attach to the platen in a way which, on one hand, maintains a low package profile and, on the other hand, allows the device to conform to an uneven mounting surface without compromising standard platen flatness and alignment tolerances.

The present invention has the further advantage that it allows a thin mouse pad or a digitizer pad to be attached to the platen surface. Furthermore, the detachable slide pivot prevents damage during handling and shipping. Furthermore, the mounting surface can be utilized to support the slide assembly, including wheels attached to the slide to permit the linear translator to pivot.

In addition, the cradle or arm rest is easily removable by the operator so that it can be replaced with individualized cradles which is particularly useful where computer equipment has multiple users. In a keyboard embodiment of the present invention, a compliant cradle mount allows some vertical translation as well as horizontal translation.

BRIEF DESCRIPTION OF THE DRAWINGS

These and other features, objects and advantages of the present invention will become more apparent from the following detailed description of presently preferred embodiments when taken in conjunction with the accompanying drawings wherein.

DETAILED DESCRIPTION OF THE DRAWINGS

Figure 1:
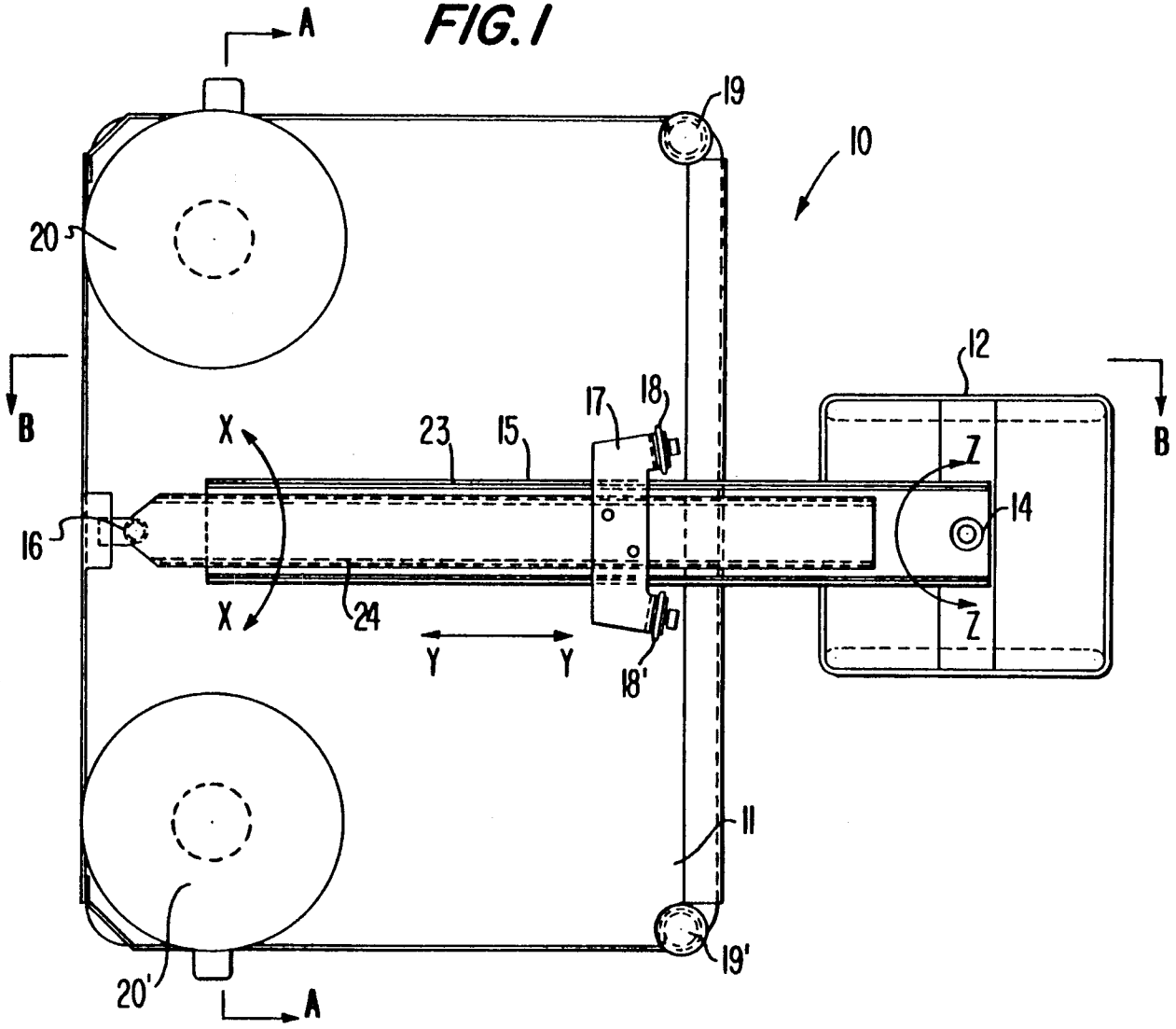
FIG. 1 is a bottom plan view of an armrest in accordance with the present invention used in connection with mouse pads and digitizer pads.
Figure 2:
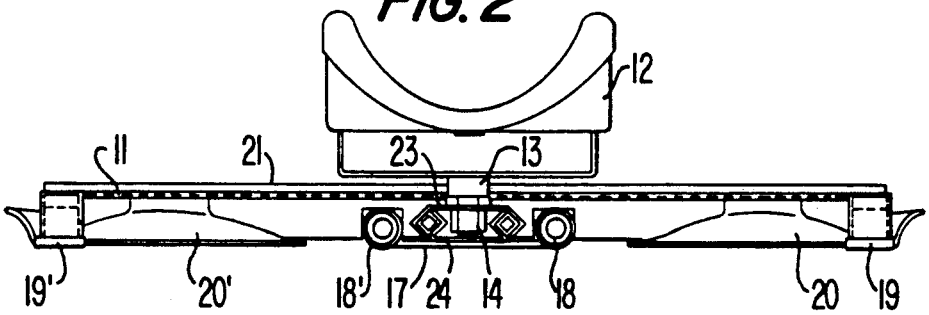
FIG. 2 is a front view of the armrest of FIG. 1.
Figure 3:
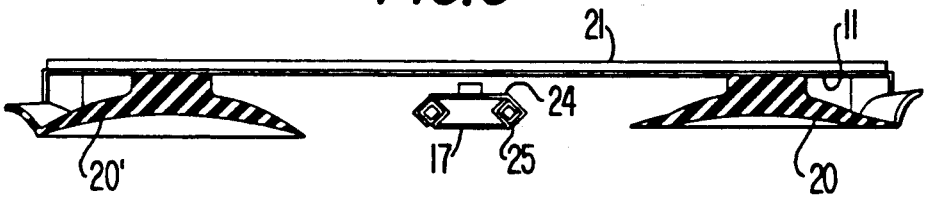
FIG. 3 is a sectional elevation view taken along line A—A of FIG. 1.
Figure 4:
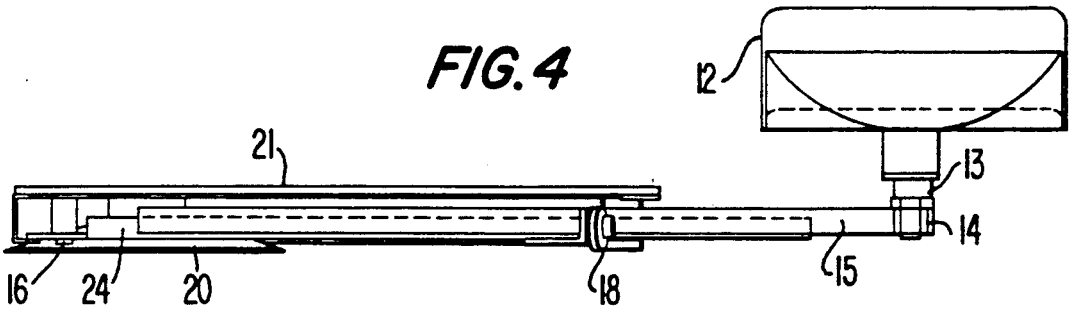
FIG. 4 is a sectional elevation view taken along line B—B of FIG. 1.

Referring now to FIG. 1, there is shown an armrest assembly designated generally by the numeral 10. The assembly 10 includes a platen 11 which can be constructed from sheet metal or produced from some other suitably durable, lightweight material such as plastic which provides a thin profile (e.g. ¾ inch). A cradle 12 is mounted on a projecting shank 13 from the bottom of the cradle 12, and the shank 13 allows for simple rotational adjustment to accommodate the orientation of the user's arm when using the armrest assembly 10. The shank 13 is received in a support post 14 which can be a lubricated plastic member to provide a low swivel friction so that the armrest cradle 12 swivels easily in response to the changing orientation of the user's arm.

The support post 14 is provided in a detachable linear slide assembly 15 which itself is supported and pivoted at an end 16 opposite from the cradle 12. The slide assembly 15 comprises two sheet metal parts 23, 24 and is supported near its other end by a bracket 17 which is fixed to the part 24 and which includes two rollers 18, 18' that contact the desk or table top (not shown). The support post 14 is provided in the part 23 which slides relative to the inside post 24 by way of eight cylindrical rollers 25 riding on rails formed on the sheet metal parts 23, 24. The fixed pivot 16 is attached to the platen assembly 11 which is supported at the front end by two rubber feet 19, 19' and at the rear portion of the platen assembly 11 by two vacuum cup assemblies 20, 20'.

Figure 10A:
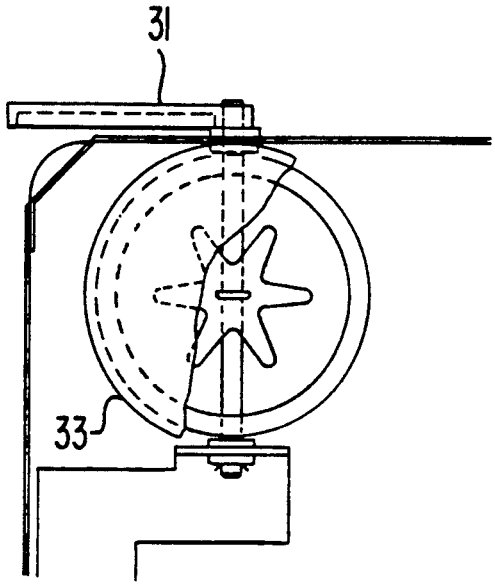
FIG. 10A–10C shown a portion of an embodiment similar to that of FIGS. 1 and 9 but utilizing handle-actuated diaphragm in lieu of suction cups.
Figure 10B:
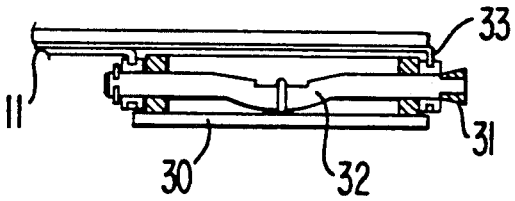
Figure 10C:
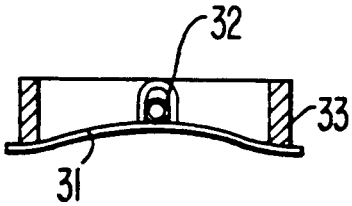

In lieu of the vacuum cups, vacuum assemblies can be used which employ a handle actuated diaphragm which conforms to the desk or table top as shown in FIGS. 10A–10C. In the relaxed position, the diaphragm 30 will conform to the table top. By rotating a handle 31 through 180°, the diaphragm 30 shown in FIG. 10B can be raised through an eccentric crank arrangement 32 to the position shown in FIG. 10C to create a pressure difference within the area defined by the cup 33 and result in a holding force to the table or desk top. It will also be appreciated that other clamping means can be used to accomplish this hold down such as threaded clamps, toggles and the like. An important criteria in the selection of the clamping means is that which provides the greatest flexibility and ease of installation in any particular circumstances.

A mouse pad 21 such as a foam rubber cushion covered with a nylon fabric or a known thin digitizer pad which is much thinner than earlier versions of such pads can cover the top of the platen assembly 11. It should again be appreciated that the foregoing structure can be adapted to other computer type equipment such as a digitizer pucks, digitizer pens and trackballs.

Figure 5:
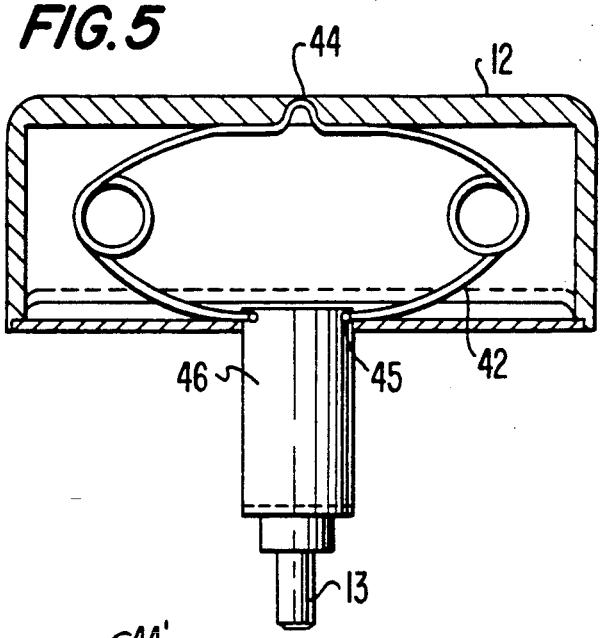
FIG. 5 is a detailed sectional side view of the armrest cradle shown in FIGS. 1 to 4.
Figure 6:
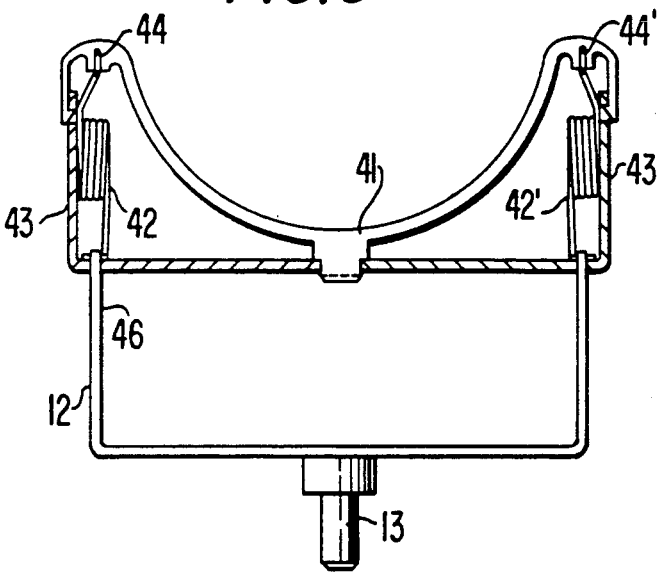
FIG. 6 is a detailed sectional front view of the armrest cradle of FIG. 5.
Figure 7:
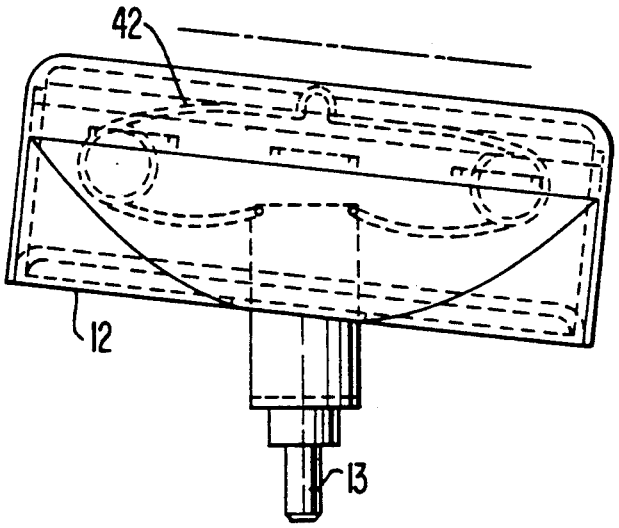
FIG. 7 is side view of the armrest cradle of FIGS. 5 and 6 but inclined in angle to accommodate a user's arm.
Figure 8:
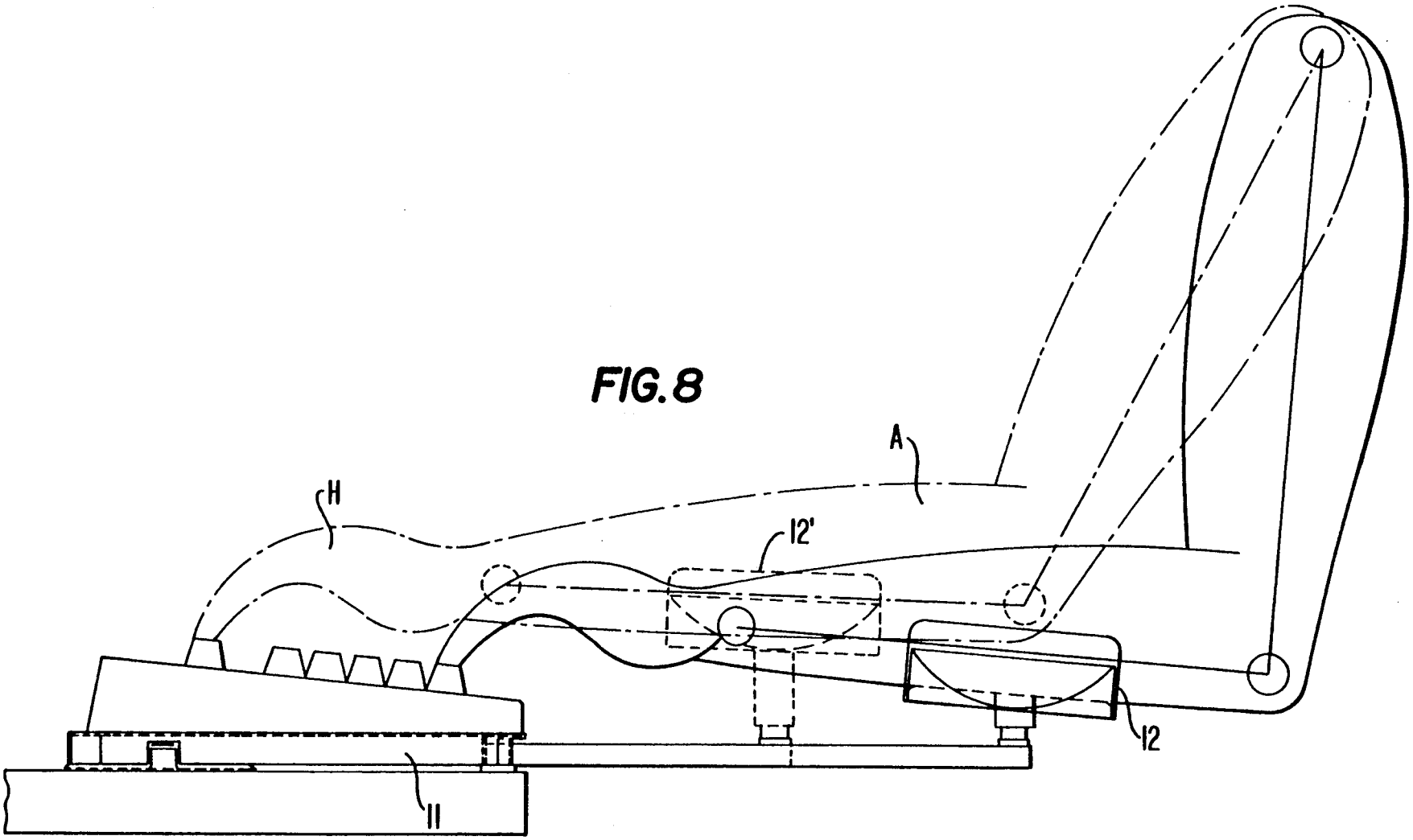
FIG. 8 is a view of the armrest device shown in FIGS. 1 to 7 with the user's hand and arm shown in one rearward position in solid line and in another more forward position in dash lines.

FIGS. 5–7 shown details of the cradle 12 which has a U-shaped upper surface 41 to accommodate the user's forearm A (FIG. 8). Two low-rate torsion springs 41, 42 are provided adjacent side walls 43 of the cradle 12. One leg 44, 44', of the respective springs 42, 42' are fixed in the cradle rest and another leg 45, 45' is fixed in a U-shaped member 46 which is movable vertically relative to the side walls 43. The springs 42, 42' provide an upward biasing force to counteract the weight of the operator's arm but is slightly less. As seen in FIG. 7, the cradle 12 can tilt from the horizontal but the springs restore it to a horizontal position when the forearm is removed.

Figure 11:
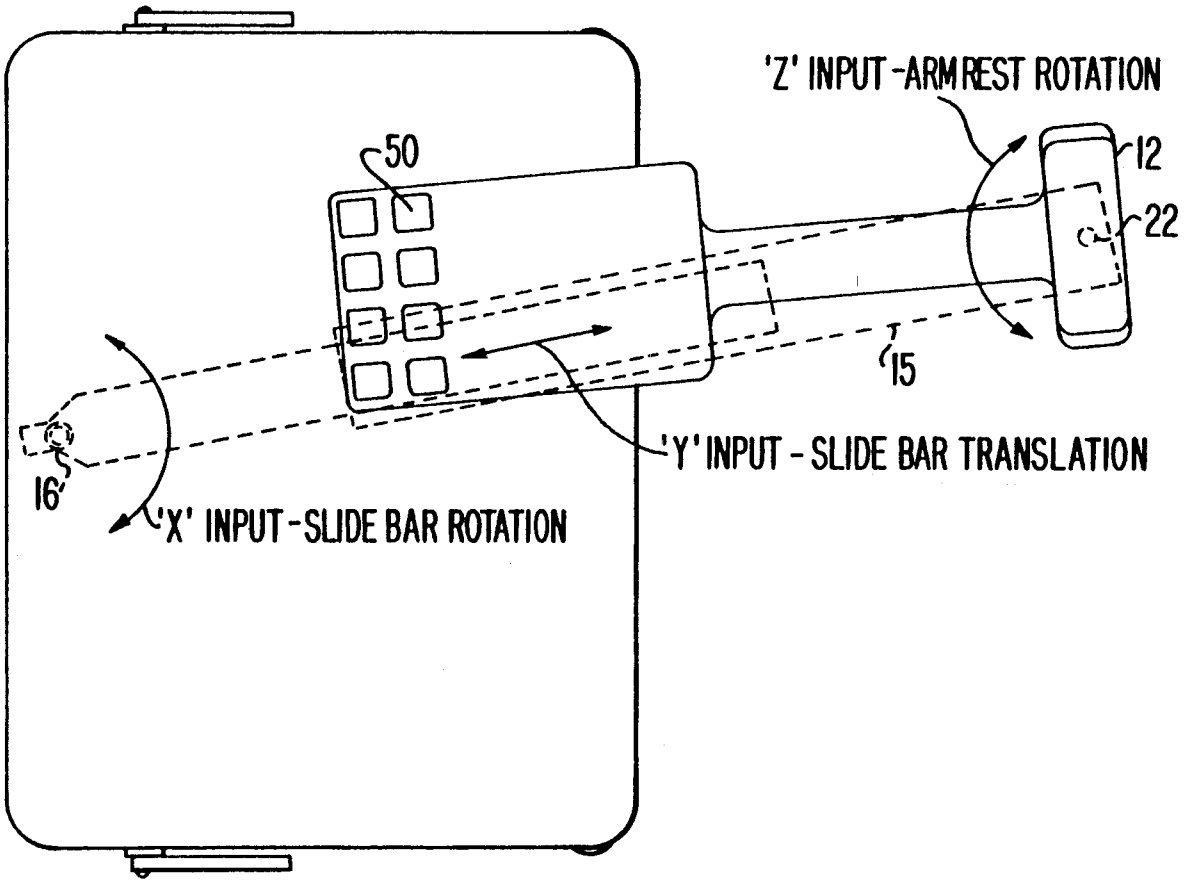
FIG. 11 is yet another embodiment of the present invention utilizing an auxiliary keypad as part of a three dimensional input device with "X", "Y" and "Z" inputs.

In another embodiment of the present invention (FIG. 11), the armrest assembly can be used directly as a three dimensional input device. That is, an auxiliary keypad unit 50 can be provided for the operator's fingers. Rotational motion of the slide 15 at its pivot 16 provides an "X" input to a transducer (not shown) attached at the pivot 16, and linear motion of the slide serves as a "Y" input to a linear transducer (not shown). Rotation of the cradle 12 itself about a pivot 22 constitutes a "Z" input for a third transducer (not shown). These transducer signals can be combined, via an algorithm, to provide a natural feedback so that when the slide assembly is pivoted in the "X" direction, the algorithm through an appropriate control to cause some rotation and translation while still resulting in "X" motion feedback.

Figure 9:
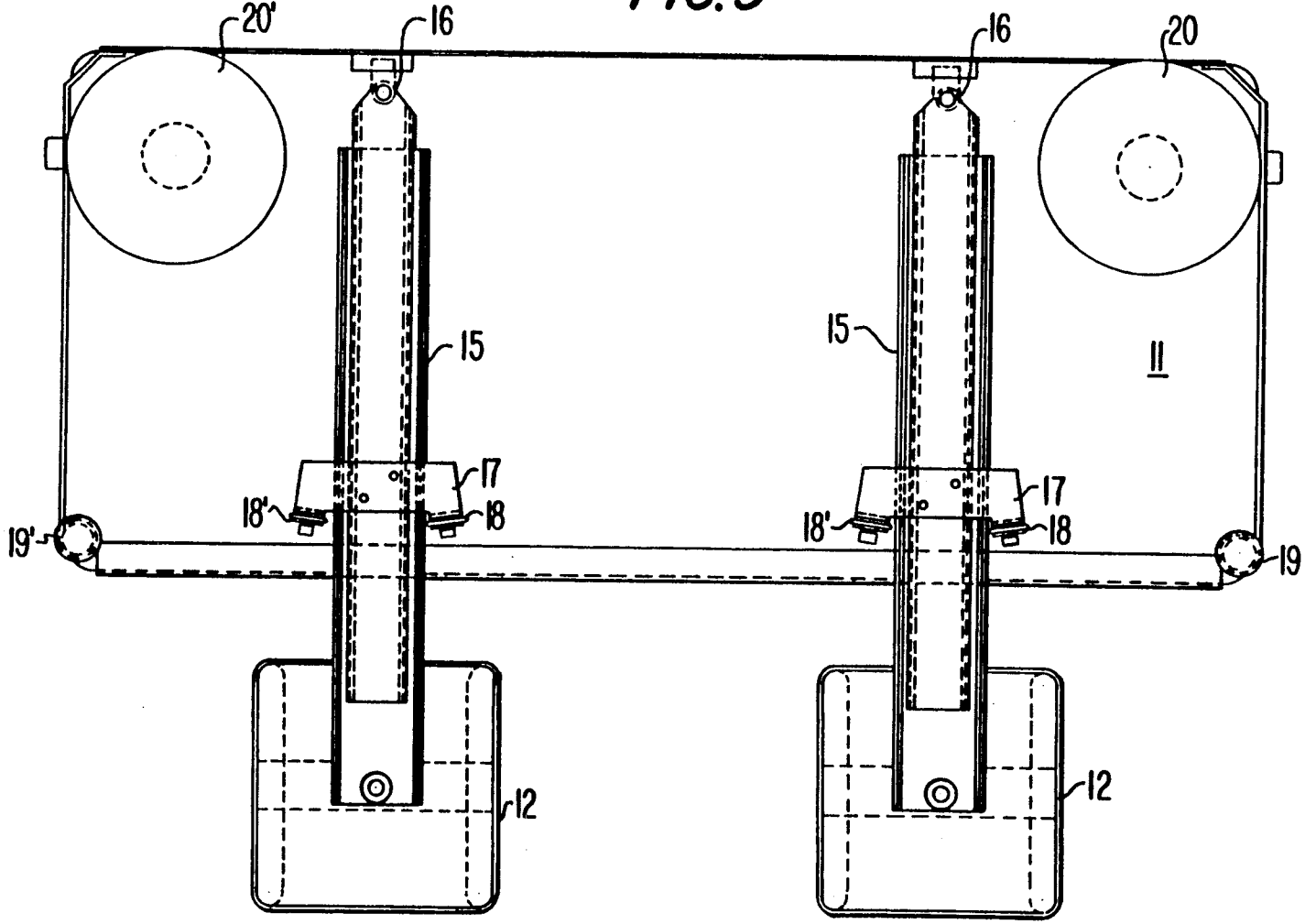
FIG. 9 is a top plan view of a second embodiment of the armrest of the present invention in which two armrests cradles are used in connection with a computer keyboard.

In another embodiment of the present invention shown in FIG. 9, the platen assembly 11 is designed for use with a PC keyboard (not shown). The parts in this embodiment which are identical with the embodiments of FIGS. 1 to 7 are designated by the same numerals. The keyboard embodiment is in all respects similar to the first embodiment but is somewhat larger to conform to the overall dimensions of the keyboard and contains two pivoting slide assemblies 15 and two cradle arm rests 12.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. An arm rest assembly for use with computer peripherals, comprising a thin profile platen;

means for clamping the platen to a mounting surface;

at least one slide comprising a plurality of parts, one of which is detachably pivoted to the platen and the other of which is linearly movable relative to the one part;

at least one cradle swivelably associated with the other part of the at least one slide and having an outer surface configured to a shape of a user's forearm; and a bracket operatively connected with the one part of the at least one slide and being provided with at least one roller adapted to roll on the mounting surface for allowing support and pivotal movement of the at least one slide.

2. The arm rest according to claim 1, wherein the clamping means comprise thin profile diaphragms actuable by an associated handle to create a vacuum holding force between the platen and the surface.

3. The arm rest according to claim 1, wherein the platen has an upper surface adapted to receive one of a mouse pad and a digitizer pad.

4. The arm rest according to claim 1, wherein the at least one cradle is removable from the at least one slide and is adapted to be interchanged with cradles having different physical characteristics.

5. The arm rest according to claim 1, wherein the clamping means comprise thin profile vacuum cups located at two corners of the platen for accommodating uneven mounting surfaces.

6. The arm rest according to claim 5, wherein the at least one cradle is provided with means for exerting an upward biasing force to allow certain vertical translation and cradle tilting while still providing support for the user's respective forearms; and wherein rollers are provided between opposing portions the parts of the at least one slide to permit linear relative movement between the parts and to maintain a low profile.

7. The arm rest according to claim 1, wherein the at least one cradle is provided with means for exerting an upward biasing force to allow certain vertical translation and cradle tilting while still providing support for the user's respective forearm.

8. The arm rest according to claim 6, wherein the upward biasing force means comprises torsion spring means operatively arranged within the at least one cradle so as to connect two portions of the cradle for relative vertical motion and tilting.

9. The arm rest according to claim 7, wherein the platen has an upper surface adapted to receive one of a mouse pad and a digitizer pad.

10. The arm rest according to claim 9, wherein the at least one cradle is removable from the at least one slide and is adapted to be interchanged with cradles having different physical characteristics.

11. The arm rest according to claim 10, wherein the upward biasing force means comprises torsion spring means operatively arranged within the at least one cradle.

12. The arm rest according to claim 11, wherein the clamping means comprise thin profile vacuum cups located at two corners of the platen for accommodating uneven mounting surfaces.

13. The arm rest according to claim 1, wherein rollers are provided between opposing portions formed as rails of the parts of the at least one slide to permit linear relative movement between the parts and to maintain a low profile.

14. The arm rest according to claim 13, wherein the at least one slide and the associated bracket are provided at a surface of the platen adapted to face the mounting surface.

15. The arm rest according to claim 14, wherein the platen has an upper surface adapted to receive one of a mouse pad and a digitizer pad.

16. The arm rest according to claim 15, wherein the at least one cradle is removable from the at least one slide and is adapted to be interchanged with cradles having different physical characteristics.

17. The arm rest according to claim 16, wherein the at least one cradle is provided with means for exerting an upward biasing force to allow certain vertical translation and cradle tilting while still providing support for the user's respective forearm.

18. The arm rest according to claim 17, wherein the upward biasing force means comprises torsion spring means operatively arranged within the at least one cradle so as to connect two portions of the cradle for relative vertical motion and for tilting of about 10° from a vertical position of the cradle.

19. The arm rest according to claim 18, wherein the clamping means comprise thin profile vacuum cups located at two corners of the platen for accommodating uneven mounting surfaces.

20. The arm rest according to claim 18, wherein the clamping means comprise thin profile diaphragms actuable by an associated handle to create a vacuum holding force between the platen and the surface.

* * * * *